US009901504B2

(12) United States Patent
Lamberton

(10) Patent No.: US 9,901,504 B2
(45) Date of Patent: Feb. 27, 2018

(54) APPLIANCE FOR USE IN SUPPORTING A WOMAN DURING THE FIRST STAGE OF LABOUR

(71) Applicant: Marie Colette Lamberton, Loftus (AU)

(72) Inventor: Marie Colette Lamberton, Loftus (AU)

( * ) Notice: Subject to any disclaimer, the term of this patent is extended or adjusted under 35 U.S.C. 154(b) by 0 days.

(21) Appl. No.: 15/504,535

(22) PCT Filed: Aug. 12, 2015

(86) PCT No.: PCT/AU2015/050458
§ 371 (c)(1),
(2) Date: Feb. 16, 2017

(87) PCT Pub. No.: WO2016/025993
PCT Pub. Date: Feb. 25, 2016

(65) Prior Publication Data

US 2017/0239121 A1 Aug. 24, 2017

(30) Foreign Application Priority Data

Aug. 18, 2014 (AU) ..... 2014903206

(51) Int. Cl.

| | |
|---|---|
| ***A61G 7/10*** | (2006.01) |
| ***A61G 15/00*** | (2006.01) |
| ***A61G 15/12*** | (2006.01) |
| ***A47C 7/50*** | (2006.01) |
| ***A47C 7/00*** | (2006.01) |

(52) U.S. Cl.
CPC ..... *A61G 15/005* (2013.01); *A47C 7/006* (2013.01); *A47C 7/506* (2013.01); *A61G 15/12* (2013.01)

(58) Field of Classification Search
CPC ..... A61G 7/10
USPC ..... 5/602, 81.1, 86.1, 83.1
See application file for complete search history.

(56) References Cited

U.S. PATENT DOCUMENTS

| | | | | |
|---|---|---|---|---|
| 4,529,247 | A | 7/1985 | Stumpf et al. | |
| 6,520,578 | B1 | 2/2003 | Jospa et al. | |
| 7,445,291 | B2 | 11/2008 | Parkel et al. | |
| 2008/0217982 | A1 | 9/2008 | Parkel et al. | |
| 2011/0138532 | A1* | 6/2011 | Lin | A61G 7/1019 5/86.1 |

FOREIGN PATENT DOCUMENTS

| | | | |
|---|---|---|---|
| CN | 202086692 | U | 12/2011 |
| CN | 202568740 | U | 12/2012 |
| WO | 1994009740 | A1 | 5/1994 |

* cited by examiner

*Primary Examiner* — Fredrick C Conley
(74) *Attorney, Agent, or Firm* — Pearne & Gordon LLP

(57) ABSTRACT

An appliance for use in supporting a woman during the first stage of labor including: a seat portion; a generally horizontal ledge portion is located at a height which is higher than the seat portion and extends across the width of the seat portion; a footrest is located at either side of the ledge portion; and wherein the footrests are located beneath the ledge portion.

7 Claims, 5 Drawing Sheets

APPLIANCE FOR USE IN SUPPORTING A WOMAN DURING THE FIRST STAGE OF LABOUR

TECHNICAL FIELD

The present invention relates to devices to assist a woman in labour and particularly relates to an appliance for supporting a woman during the first stage of labour.

BACKGROUND TO THE INVENTION

Labour has its inherent maternal and fetal obstacles to overcome including:

Length of time of labour

Pain of contractions

Tiredness of the woman

Difficulty of physically supporting oneself when in pain and tired.

The fetus has to flex, descend into, rotate, mould, and descend through the pelvic bones and pelvic outlet.

Women who are in the active phase of the first stage of labour find it physically difficult to continue to mobilize. In this stage women want to be quiet and introspective as the contractions become more intense and frequent. In the active phase of the first stage of labour Midwives and birth attendants find it difficult to continue to encourage the labouring woman to mobilize and remain upright.

There remains a need to provide improved means to assist women in labour.

SUMMARY OF THE INVENTION

The present invention provides an appliance for use in supporting a woman during the first stage of labour including: a seat portion; a generally horizontal ledge portion is located at a height which is higher than the seat portion and extends across the width of the seat portion; a footrest is located at either side of the ledge portion; and wherein the footrests are located beneath the ledge portion.

The ledge portion may be located at about shoulder height of a woman sitting on the seat portion.

The footrests may be retractable.

The ledge portion may be joined to the seat portion by an intermediate portion which shields the anterior of a woman sitting on the seat portion.

The seat portion, ledge portion and intermediate portion may be integrally formed.

The seat portion may be spaced away from the ground by a number of legs.

The appliance may further include wheels.

The wheels may be swiveling castor wheels.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
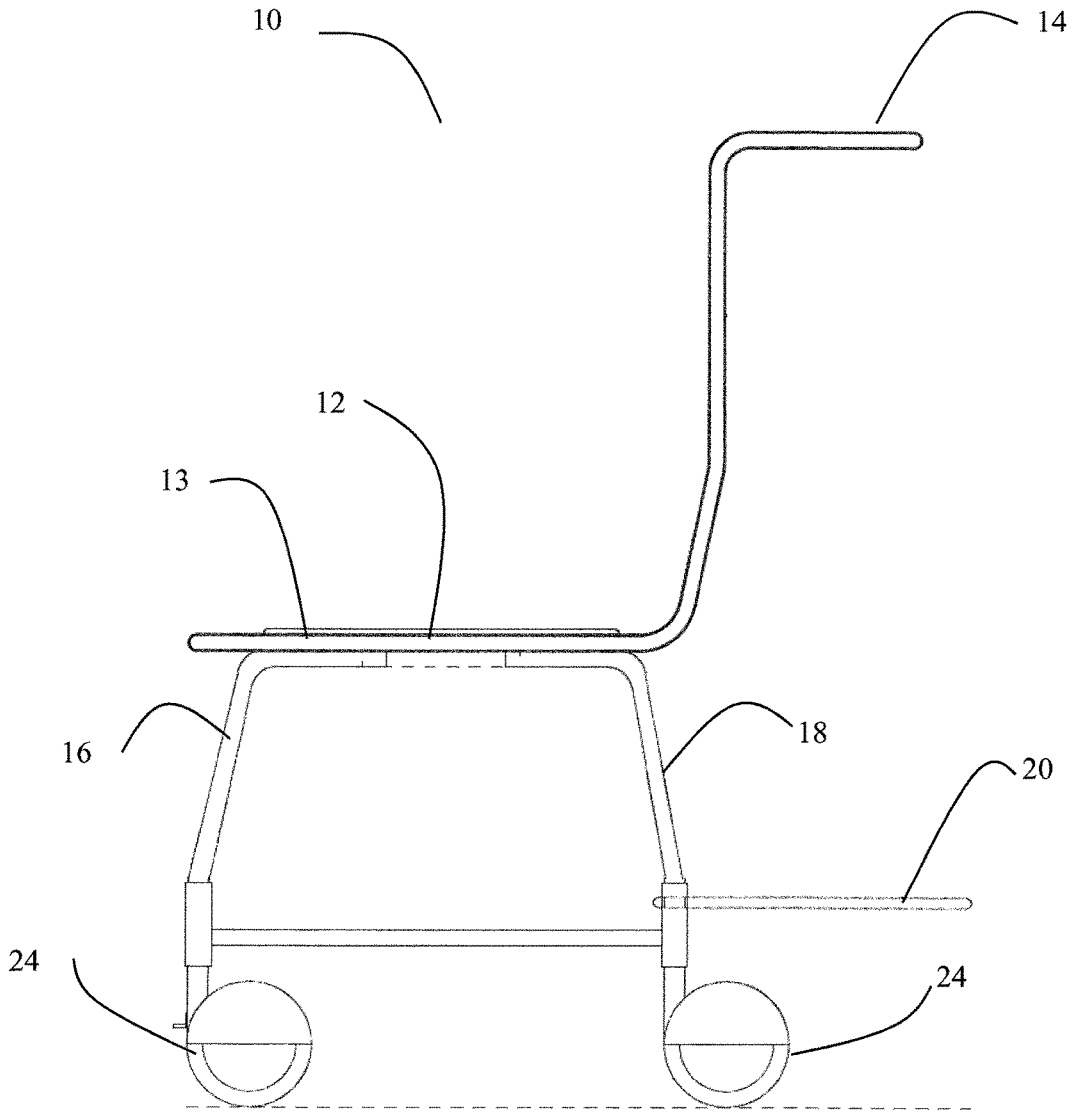
FIG. 1 is a side view of an appliance according to an embodiment of the invention.
Figure 2:
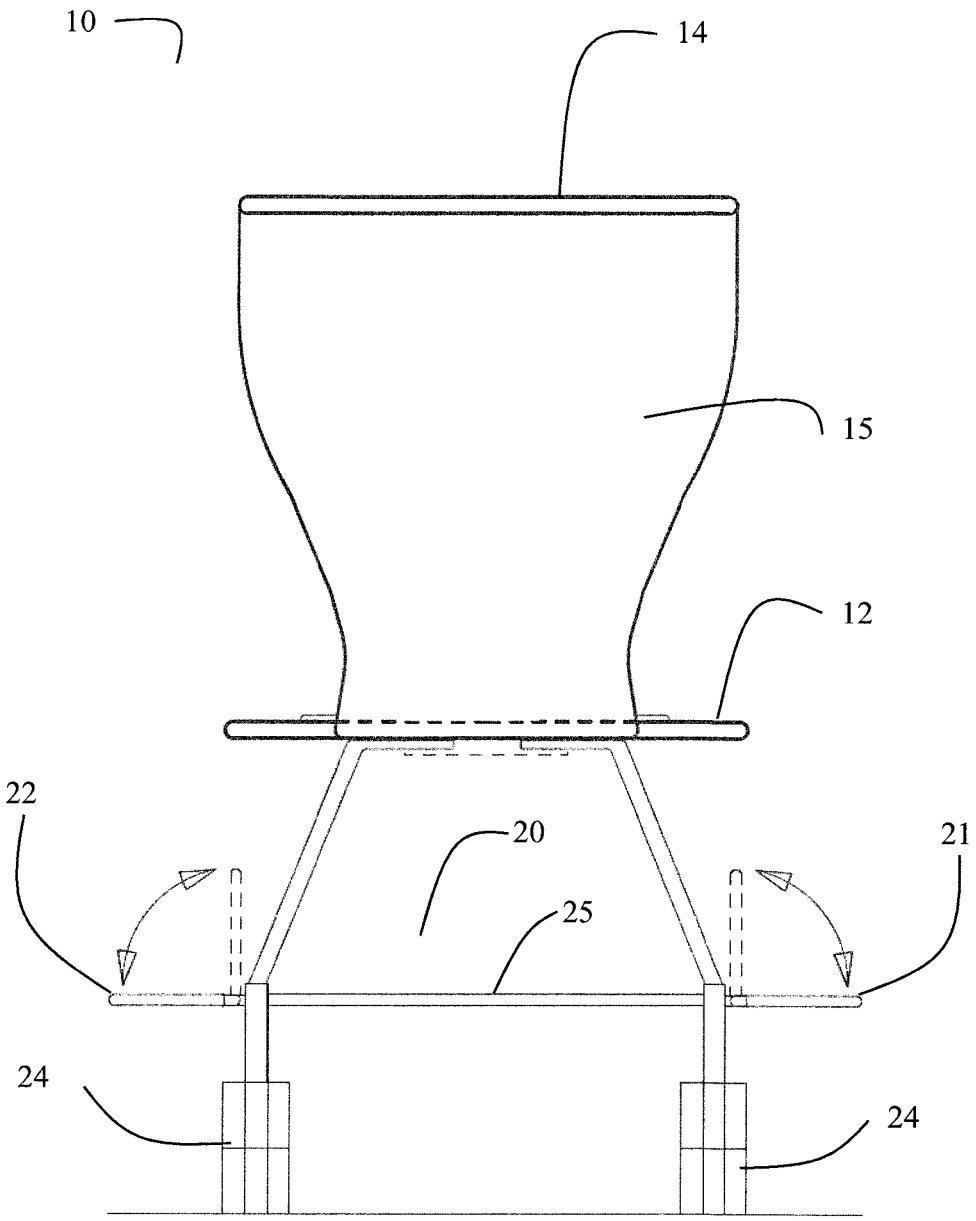
FIG. 2 is a front view of the appliance of FIG. 1.
Figure 3:
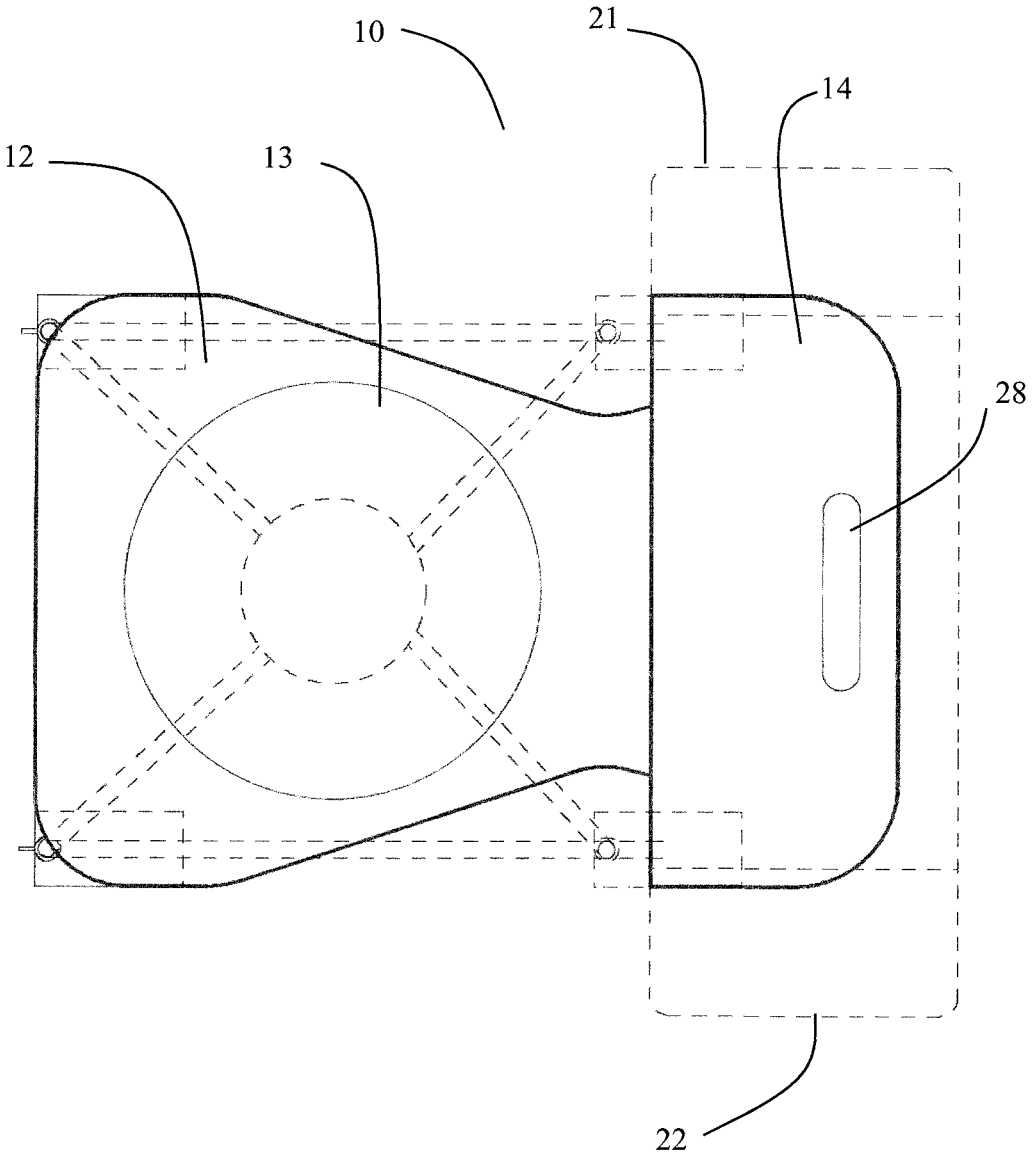
FIG. 3 is a top view of the appliance of FIG. 1.

Referring to FIGS. 1 to 3, an appliance 10 is shown for supporting a woman during the first stage of labour including a seat portion in the form of seat 12 and a generally horizontal ledge portion in the form of ledge 14. Seat 12 is supported on a pair of front legs 18 and a pair of rear legs 16 which are provided with swiveling castor wheels 24. The wheels of the front legs 18 are lockable.

A footrest arrangement 20 is located beneath ledge 14. As best seen in FIG. 2, footrest arrangement is made up of a fixed plate 25 to which footrest portions in the form of footrest flaps 21, 22 are hingedly mounted. The footrest flaps are retractable by folding upwards as shown by the arrows in FIG. 2.

A handle cut-out 28 allows the appliance to be grasped and moved along on its wheels.

The ledge 14 is joined to the seat 12 by an intermediate portion 15. The ledge 14, seat 12 and intermediate portion are formed in one continuous piece such as by injection moulding from polypropylene or a similar material. Seat 12 is fitted with a removable cushion 13. The legs 16, 18 are fabricated from tubular steel.

Figure 4:
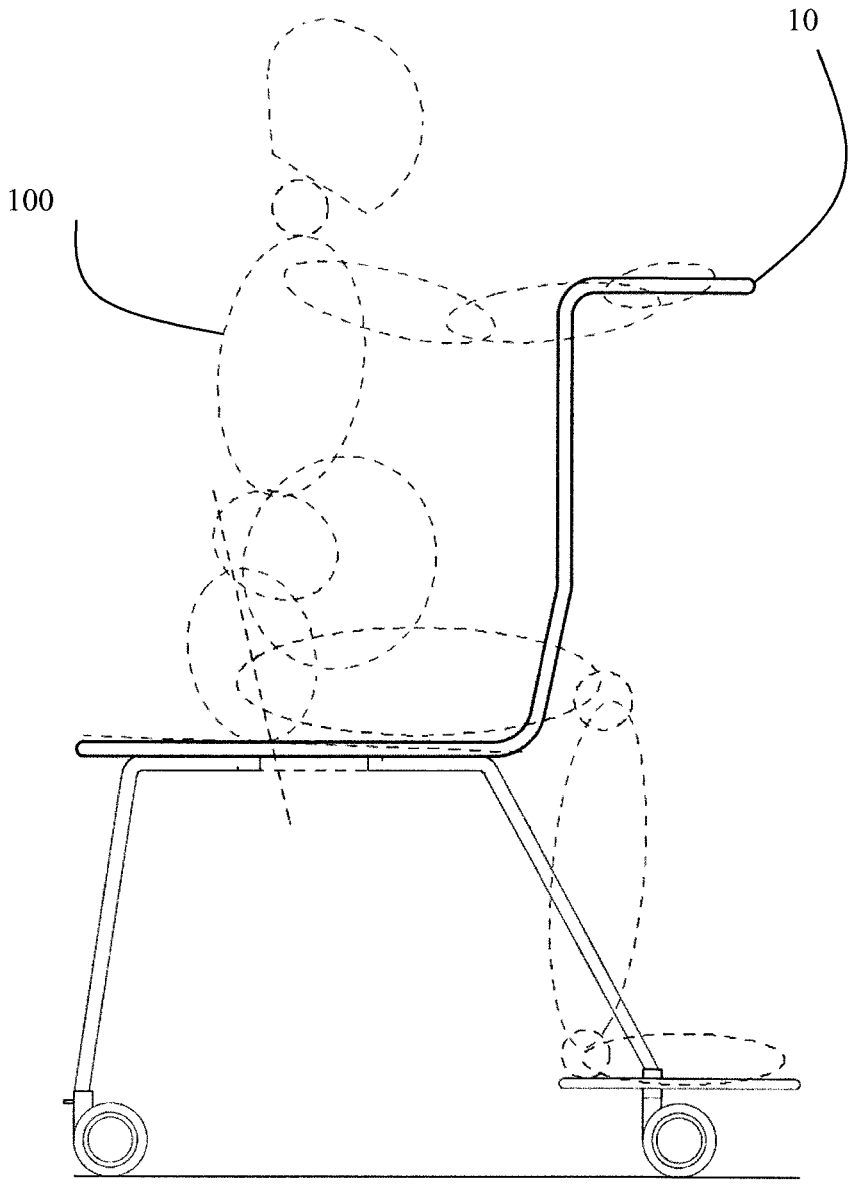
FIG. 4 shows a woman sitting on the appliance of FIG. 1.

Referring to FIG. 4, a woman 100 is shown sitting on the appliance 10. The woman sits astride the appliance, facing the contoured intermediate portion 15. The woman can lean forward to rest both her arms and head on the ledge 14 that is situated at shoulder height. The woman may use a pillow in conjunction with the ledge for additional comfort.

The intermediate portion of the appliance is approximately 28 cm wide at its narrowest point. The seat is long to accommodate the pregnant uterus. The seat is broad at the buttock end to allow the woman to sit safely on the seat. The footrest maintains a 90° angle at the hip.

Hot packs, Tens machines, Nitrous Oxide and Narcotics can be administered in this position. If the woman wants to be in the shower and hasn't the energy to stand herself, the appliance can be wheeled in to the shower. The woman can gain the benefit of the supported position whilst enjoying the comfort of warm shower water running over her.

The footrests are used if the woman's feet do not touch the ground or to change the angle of her pelvis. The footrest arrangement allows the woman to sit with feet either inside or outside the legs of the appliance, whichever is of most comfort for her.

The woman can relax and feel safe. She no longer has to support her own weight. She is relatively comfortable and will not fall. The vulnerable anterior (front) of her body is protected and supported by the ledge 14 and intermediate portion 15 of the appliance. She can truly rest with her head or arms on the pillow ledge. She does not have to utilise her musculature to support herself. She can concentrate on relaxing all her muscles including her pelvic floor. She can allow all her muscles to soften and relax, enabling the fetal head to descend and rotate into her pelvis during the course of her labour.

The seat 12 of the appliance has a neutral angle/horizontal, to allow the woman to tilt her pubic bone upwards towards her navel (slumped), to reduce the Angle of Inclination (From 55° to 29°) at the pelvic brim. She can rest her feet forward to have 90° at hip and knee, if her feet don't touch the floor, she can rest her feet on the footrest for comfort. This enables the fetal head to sit over, rather than in front of the pelvis brim. This simple manoeuvre can assist in overcoming bony obstruction of the maternal pelvis as there is flexibility in the pelvic bones. The internal diameters of the maternal pelvis can be increased by an extra 28% by this positioning. The fetus adjusts its position and its head moulds accordingly.

Figure 5:
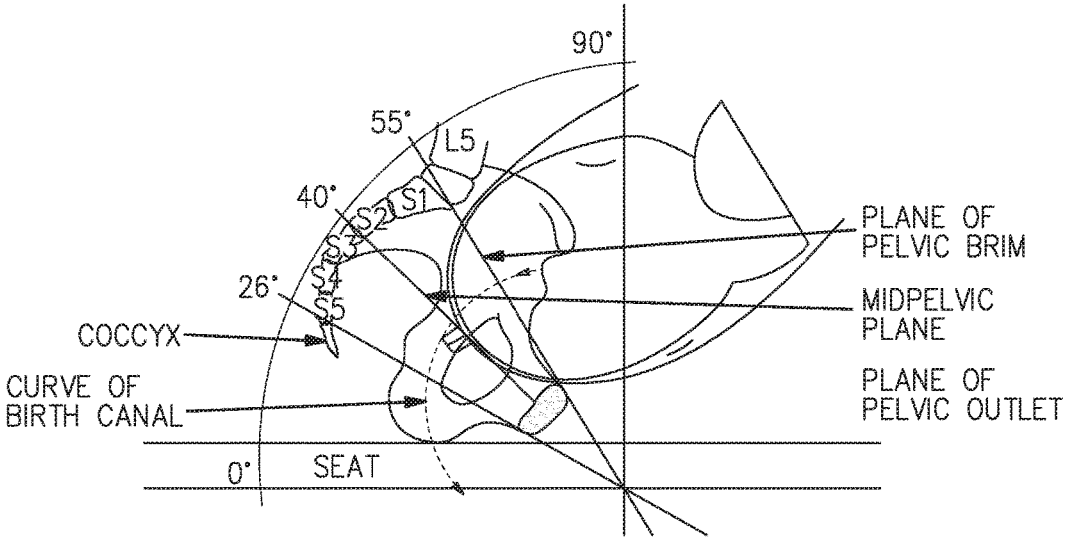
FIGS. 5 and 6 illustrate the change in the angle of Inclination of the pelvis that results from the use of the appliance of FIG. 1.
Figure 6:
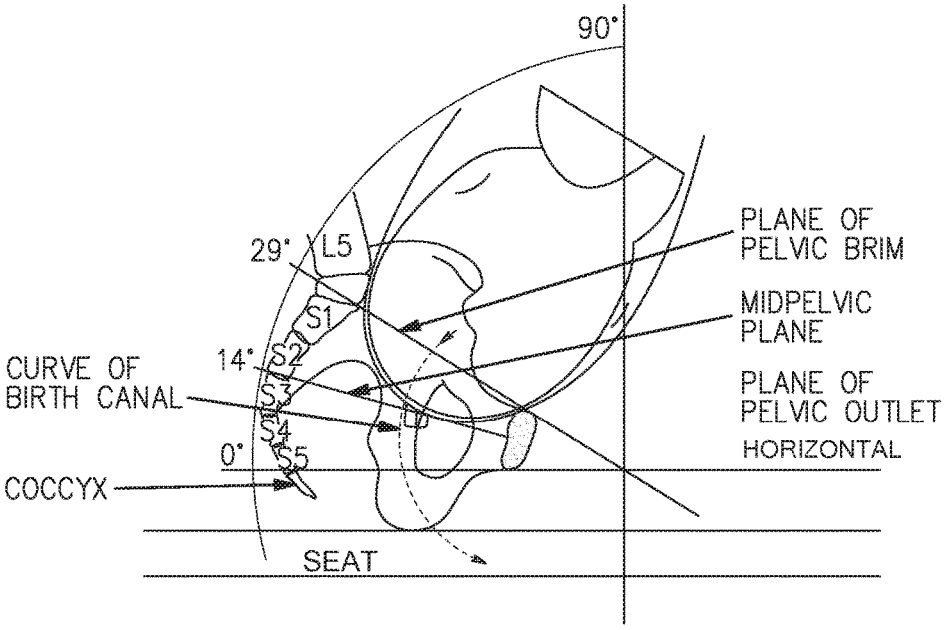

The concept of the Angle of Inclination is illustrated in FIGS. 5 and 6. The pelvic planes refer to hypothetical flat surfaces on the pelvis, which are located at the brim, cavity and pelvic outlet. Taking the pelvic brim as our landmark, (A line from the sacral promontory to the upper edge of the symphysis pubis) The plane of the brim is an angle of 55° to the horizontal. This is called 'The Angle of Inclination.'

The fetal head enters the pelvis in front of the pelvic brim. (FIG. 5). The Plane of the Pelvic Outlet, is an angle of 15-30° to the horizontal (A line from the junction of the coccyx and the 5th sacral vertebrae). When the woman tilts her pelvis upward on her ischial tuberosisties, (Slumps) she reduces 'The Angle of Inclination' of the plane of her pelvic brim to approximately 29°. (FIG. 6). This allows the fetal head to sit over the pelvic brim rather than in front of it. This optimises the ability of the uterine contractions and the 'Fetal Axis Pressure' to direct the fetal head into the pelvis. The plane of the outlet moves to the horizontal 0°. I.e. the symphysis pubis rises so the lower edge is level with the 5th vertebrae of the sacrum.

The posture encouraged by the appliance allows the fetal head to give strong stimulation to the cervix (known as 'Fetal Axis Pressure'). The fetus has to flex, descend into the pelvic brim, rotate, mould, and descend through the pelvic bones and pelvic outlet. By a process known as 'Positive Feedback', the Fetal Axis Pressure encourages the release of oxytocin which in turn enhances contraction strength and frequency and allows the fetal head to perform its internal mechanisms.

The appliance allows the woman to gain benefit from the intrinsic processes of the 'Positive Feedback', 'Fetal Axis Pressure', and the mobility of her pelvic joints, which allow greater internal diameters (extra 28%).

The woman can remain supported on the appliance until she requests an Epidural Block, or until the time of active pushing in the second stage of labour, when she would need to move from the appliance.

In the embodiment described above the ledge 14, seat 12 and intermediate portion were formed in one continuous piece. In other embodiments they may be formed in separate pieces and then subsequently joined together.

It can be seen that embodiments of the invention have at least one of the following advantages:

The labouring woman can sit forward, with her pelvis open, comfortably, in a safe, fully supported, non-vulnerable, upright position. This posture physically and emotionally benefits her labour, by enhancing:

a. 'Positive Feedback Mechanism' b. 'Fetal Axis Pressure' c. Principles of 'Active Birth' i.e. upright, pelvis open.

d. 'Angle of Inclination of the Pelvic Brim'

Assisting the fetus to flex, descend into, rotate, mould, and descend through the pelvic bones and pelvic outlet.

The appliance enables the woman to feel safe, comfortable and supported in an upright position throughout her labour.

The appliance may remove the need for an Epidural block.

The woman's back is accessible for massage by her support person.

Allows ease of access for midwifes to auscultate the fetal heart rate without disturbing the 'comfortable' woman.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. An appliance for use in supporting a woman during the first stage of labour including:

a seat portion;

a generally horizontal ledge portion is located at a height which is higher than the seat portion and extends across the width of the seat portion;

a footrest is located at either side of the ledge portion; and wherein the footrests are located beneath the ledge portion so that a woman may sit astride the appliance and lean forward to rest both her arms and head on the ledge and rest her feet on the footrests; and wherein the footrests are retractable.

2. An appliance according to claim 1 wherein the ledge portion is located at about shoulder height of a woman sitting on the seat portion.

3. An appliance according to claim 1 wherein the ledge portion is joined to the seat portion by an intermediate portion which shields the anterior of a woman sitting on the seat portion.

4. An appliance according to claim 3 wherein the seat portion, ledge portion and intermediate portion are integrally formed.

5. An appliance according to claim 1 wherein the seat portion is spaced away from the ground by a number of legs.

6. An appliance according to claim 1 which further includes wheels.

7. An appliance according to claim 6 wherein the wheels are swiveling castor wheels.

* * * * *